United States Patent [19]

Brieske

[11] 3,954,049

[45] May 4, 1976

[54] METHOD OF MAKING FLEXIBLE BAG

[75] Inventor: Bernard F. Brieske, Palatine, Ill.

[73] Assignee: Vision Wrap Industries, Inc., Palatine, Ill.

[22] Filed: Nov. 9, 1973

[21] Appl. No.: 414,200

[52] U.S. Cl. ..... 93/35 R; 93/33 H; 93/34

[51] Int. Cl.[2] ..... B31B 41/60

[58] Field of Search ..... 93/35 R, 35 H, 33 H, 93/DIG. 1, 33 R, 34; 229/55; 206/806; 156/515, 583

[56] References Cited

UNITED STATES PATENTS

| | | | |
|---|---|---|---|
| 2,878,849 | 3/1959 | Lingenfelter et al. | 93/35 R |
| 2,971,874 | 2/1961 | Canno | 93/35 R |
| 3,148,598 | 9/1964 | Davis | 93/35 R X |
| 3,282,173 | 11/1966 | Davis, Jr. et al. | 93/34 UX |
| 3,354,795 | 11/1967 | Kugler | 93/33 H |
| 3,776,798 | 12/1973 | Milano | 93/35 R X |

*Primary Examiner*—James F. Coan
*Attorney, Agent, or Firm*—McDougall, Hersh & Scott

[57] ABSTRACT

A flexible bag construction and a method for producing the bag. The construction is formed from flexible plastic films located in overlying relationship with one film defining a return portion having a free edge positioned inwardly from the top of the bag. A second free edge is defined by a separate film portion in spaced relationship relative to the first free edge. A flexible plastic strip is introduced between the return portion and the opposing film and this strip is heat sealed in place. The second free edge provides a means for inserting articles into the bag whereby the bag can be used for merchandising purposes, particularly after being sealed along the second free edge. An opening is preferably formed in the top of the bag extending through overlying film portions and the intermediate strip to provide means for suspending the bag.

4 Claims, 6 Drawing Figures

METHOD OF MAKING FLEXIBLE BAG

This invention relates to an improved method for the production of bags and to bags produced thereby. The invention is particularly directed to bags formed from flexible plastic films which are adapted to be heat sealed.

The bags produced in accordance with this invention are primarily useful for merchandising purposes. Thus, the bags may be of the type formed from flexible plastic films such as transparent polyethylene film whereby articles can be located in the bags and then merchandized in packaged form. Films of this type have great popularity due to the fact that relatively inexpensive bags can be produced, the packaged articles are visible to purchasers, and printing can be applied to the bags for decorative and informational purposes.

Cost is an extremely important factor in the production and use of bags of the type described since merchants do not wish to have any significant packaging cost added to the merchandise cost. Accordingly, manufacturing techniques and bag designs which will reduce production costs and costs involved in filling the bags are constantly being sought.

It is a general object of this invention to provide an improved method and bag design whereby bags can be produced and filled on a highly efficient basis.

It is a more specific object of this invention to provide an improved bag design which can be efficiently provided with desired printing for decorative and informational purposes, which can be efficiently provided with means for suspending the bag for merchandising purposes, and which can be very easily filled and sealed whereby articles can be packaged at relatively low cost.

It is a still further object of the invention to provide an improved method for producing bags of the type described whereby the bags can be very rapidly manufactured on a high production basis.

These and other objects of this invention will appear hereinafter and for purposes of illustration, but not of limitation, specific embodiments of the invention are shown in the accompanying drawings in which.

This invention generally relates to a method for the production of bags and to the bags produced thereby. The invention involves the location of flexible plastic films in overlying relationship with one of the films being provided with a return portion. The free edge of this return portion is located adjacent to and parallel to a free edge of the other film. A flexible strip is introduced between the return portion and the underlying film portion and heat sealing means are then utilized for forming and securing the bag construction.

The heat sealing operations preferably involve the use of a hot die whereby the desired shape of the bag is provided simultaneously with heat sealing of peripheral portions of the bag. In addition, a separate heat sealing operation is provided for purposes of securing the free edge of the return portion to the underlying film portion thereby securing the intermediate flexible strip in position. Preferably this heat sealing operation includes the heat sealing of the flexible strip to the adjacent films so that this flexible strip is held in a permanent position.

The provision of the three film layers including the return portion, the flexible strip and the underlying film automatically provides a reinforced top for the bag. A hole can be readily formed in this top so that the bag can be suspended even when low gauge film is used and relatively heavy articles are located in the bag.

The free edge which is positioned adjacent the free edge of the return portion provides a convenient means for inserting articles in the bag. This second free edge is preferably located in spaced relationship relative to the other free edge so that a tool or other means can be readily brought into engagement to expose the interior of the bag for filling purposes. After an article has been inserted, the bag can be sealed along this second free edge so that a package suitable for merchandising purposes is provided.

Figure 1:
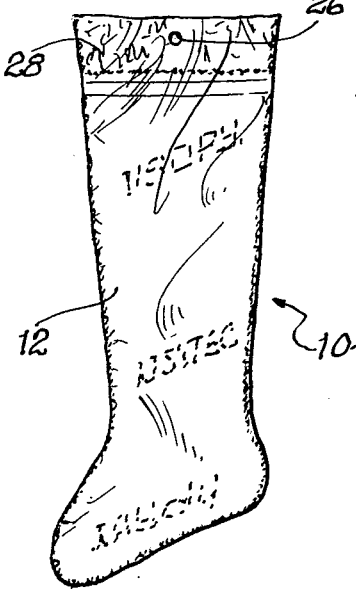
FIG. 1 is a top plan view of a bag construction in the form of a stocking characterized by the features of this invention.
Figure 2:
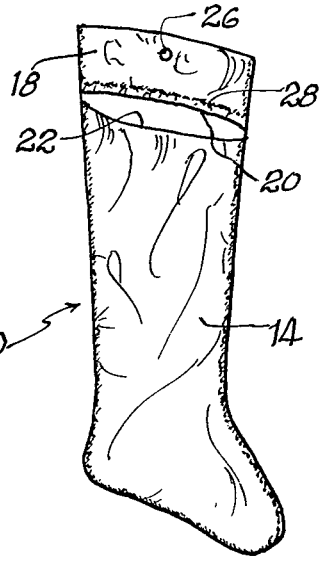
FIG. 2 is a bottom plan view of the bag shown in FIG. 1.
Figure 3:
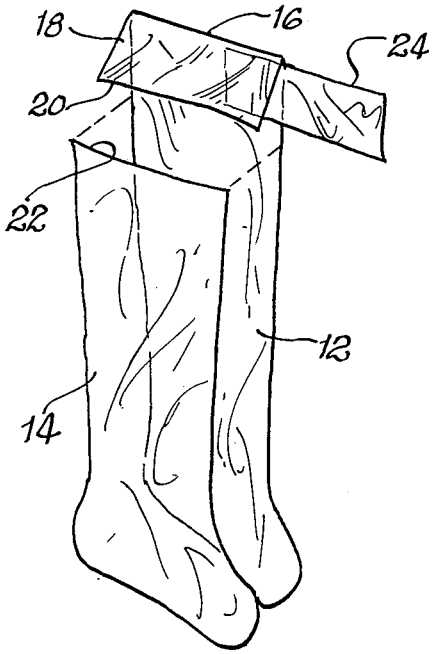
FIG. 3 is an exploded perspective view of the bag construction.

The accompanying drawings illustrate a bag 10 which includes a pair of overlying films comprising a front film 12 and a rear film 14. As best illustrated in FIG. 3, the front film 12 defines a fold 16 along the top of the bag and a return portion 18 extends beyond this fold. This return portion defines a free edge 20, and this free edge 20 is located in spaced relationship relative to free edge 22 defined by the rear film portion 14. The bag also includes a reinforcing strip 24 and a hole 26 may be formed in the bag for suspending purposes. The front and rear films 12 and 14 are heat sealed around the periphery thereof, and the heat seal line 28 extends adjacent the free edge 20 whereby the strip 24 is secured in place.

Figure 4:
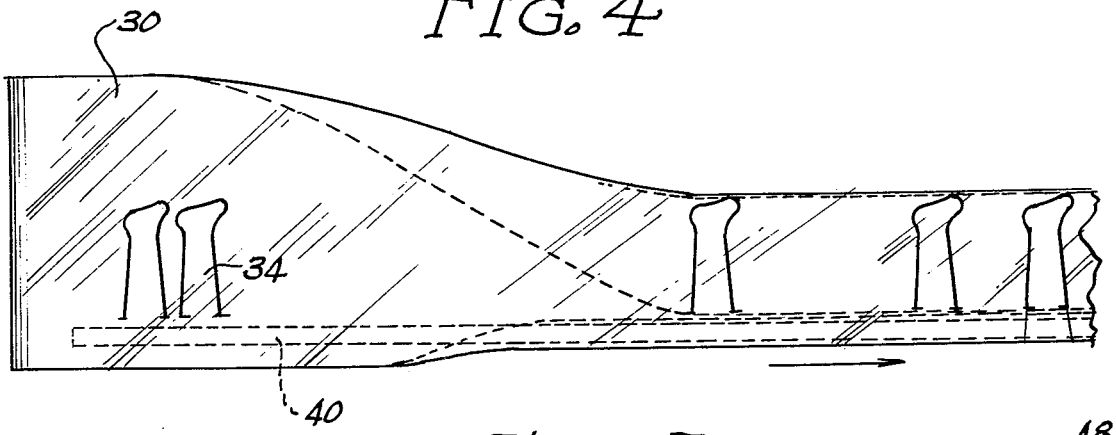
FIG. 4 is a plan view illustrating the manner in which the bags are produced from a sheet of flexible film.
Figure 5:
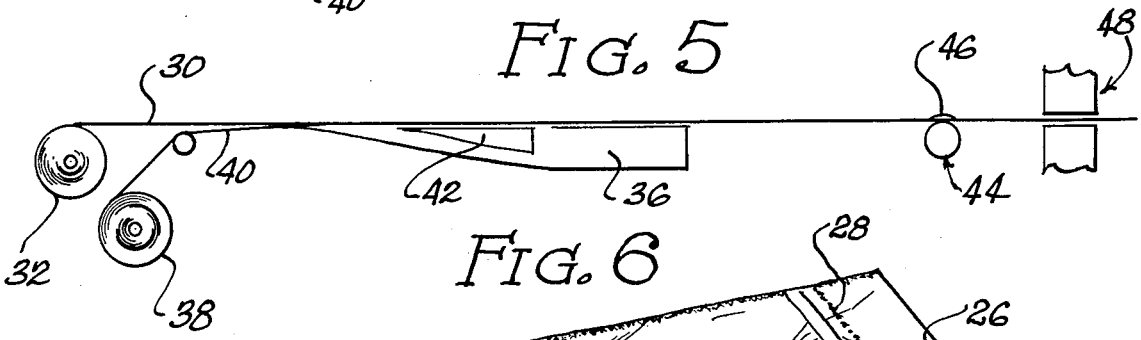
FIG. 5 is a side view of the illustration of FIG. 4.
Figure 6:
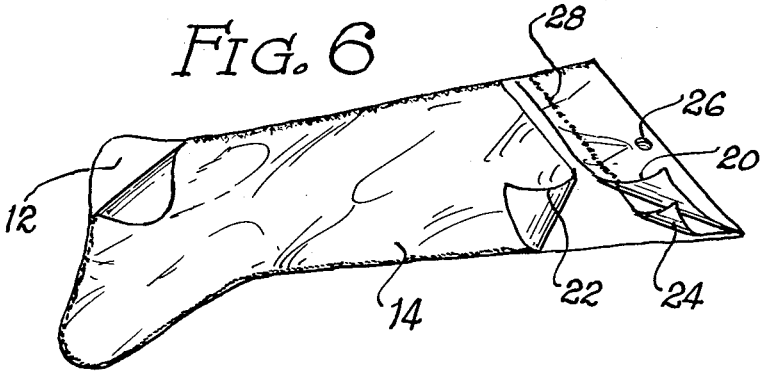
FIG. 6 is a perspective view of the bag construction showing portions thereof peeled back.

FIGS. 4 and 5 illustrate the technique employed for purposes of producing bags of the type illustrated. It has been found that the method of this invention as well as the bag structure is uniquely suitable for the production of bags in the shape of stockings; however, it will be understood that other bag shapes could be made utilizing the techniques described herein.

A sheet 30 of plastic film, for example polyethylene film, is supplied from roll 32. This sheet includes a printed portion defining outlines 34 of the desired bag configuration. As indicated, this printing is provided for decorative and informational purposes, and the printing is preferably confined to only portions of the film so that the transparent character of the film will still permit viewing of articles within a bag.

A folding mechanism 36, for example a conventional A-frame, is utilized for locating film portions in overlying relationship. It will be appreciated that in lieu of this folding mechanism, 2 films of a suitable size may be brought into the positions illustrated.

A roll 38 of flexible strip material 40 provides the source of material for the reinforcing piece 24. As best shown in FIG. 4, the strip 40 is moved along a line located inwardly of a side edge of the sheet 30. A second folding mechanism 42 is utilized for folding under this side of the sheet 30 whereby the strip 40 is automatically located between a return portion of the sheet 30 and an opposing sheet portion.

The folded assembly of the sheet 30 and strip 40 is now moved to a first heat sealing station 44 which may comprise a hot wire element 46 which directly engages or is located closely adjacent the film portions. This mechanism serves to heat seal the film along the line 28. It is preferred that the strip 40 be located whereby the inner edge of the strip is at or adjacent to the heat sealed line whereby this strip will be fully secured in the construction.

A conventional heat sealing and die cutting station 48 is provided for purposes of forming the desired outline of the bags being produced. A suitable punch may then be provided for purposes of locating the hole 26 in the top of the bag. Since the strip 40 is secured by means of the heat seal 28, then the holes in each of the three film portions will be aligned and will be maintained in alignment during the filling operation and subsequent use of the bag.

As noted, the free edge 22 is located in spaced relationship relative to the free edge 20 so that a tool or any other suitable means can readily separate the front and rear walls of the bag for the insertion of articles. Any suitable heat sealing mechanism can then be employed for purposes of sealing the bag along or adjacent to the edge 22 whereby a package suitable for merchandising is provided.

It will be understood that various changes and modifications may be made in the above described construction which provide the characteristics of the invention without departing from the spirit thereof particularly as defined in the following claims.

That which is claimed is:

1. A method for the production of a plurality of individual bags from an elongated flexible plastic film which is adapted to be heat sealed, comprising the steps of providing an elongated single thickness of film, providing a folding means and feeding said sheet to the folding means to thereby locate film portions thereof in overlying relationship, the edge of one film portion extending substantially beyond the edge of the other film portion to thereby provide an exposed single thickness film portion, introducing a flexible strip onto said exposed film portion, providing a second folding means and folding said exposed film portion to provide a return portion therein, positioning the free edge of said return portion adjacent and parallel to a free edge of said other film portion, the folding of said exposed film portion locating said strip within said return portion, heat-sealing said film portions together and to the edge of said strip adjacent said free edge of the return portion to thereby confine said flexible strip within the return portion, thereafter severing bags one at a time while simultaneously heat-sealing the bags around the severed periphery thereof, said free edge of said other film portion remaining unsealed in each bag to permit the introduction of articles into the bag, and wherein said film and said strip are continuously fed in step-by-step fashion to the folding and heat-sealing means to provide for the continuous production of bags from the film.

2. A method in accordance with claim 1 including the step of forming an opening passing through said one film portion, said return portion and said strip to thereby provide means for suspending said bag.

3. A method in accordance with claim 1 wherein said edge of said return portion is positioned in spaced apart relationship relative to said edge of the other film portion whereby articles can be readily inserted in said bag.

4. A method in accordance with claim 1 including the step of printing decorative and informational material on said one film portion, said one film portion forming the front of said bag.

* * * * *